US007047115B2

(12) United States Patent
Takada et al.

(10) Patent No.: US 7,047,115 B2
(45) Date of Patent: May 16, 2006

(54) OUTBOARD MOTOR STEERING SYSTEM

(75) Inventors: Hideaki Takada, Wako (JP); Hiroshi Mizuguchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 192 days.

(21) Appl. No.: 10/779,750

(22) Filed: Feb. 18, 2004

(65) Prior Publication Data

US 2004/0162649 A1 Aug. 19, 2004

(30) Foreign Application Priority Data

Feb. 19, 2003 (JP) ..... 2003-040835

(51) Int. Cl.
*G05D 1/00* (2006.01)
*B62D 15/00* (2006.01)

(52) U.S. Cl. ..... 701/21; 180/6.2; 701/41

(58) Field of Classification Search ..... 701/21, 701/41; 180/6.2, 6.58, 6.6; 74/492, 480 B, 74/484 R; 114/21.1, 23; 440/51–53
See application file for complete search history.

(56) References Cited

U.S. PATENT DOCUMENTS 2,507,844 A * 5/1950 Wright ..... 440/63
3,765,370 A * 10/1973 Shimanckas ..... 440/58
5,049,097 A * 9/1991 Rodskier et al. ..... 440/52
5,605,110 A * 2/1997 Talbot ..... 114/248

FOREIGN PATENT DOCUMENTS

JP 62-125996 6/1987
JP 02-279495 11/1990

OTHER PUBLICATIONS

A part of a manual for Honda outboard motor BF115A/BF130A, pp. 12-47 and 13-5, edited by Honda Giken Kogyo Kabushiki Kaisha's Department of Maintenance Materials and published on May, 1998.

* cited by examiner

*Primary Examiner*—Yonel Beaulieu
(74) *Attorney, Agent, or Firm*—Westerman, Hattori, Daniels & Adrian, LLP

(57) ABSTRACT

An outboard motor steering system for an outboard motor mounted on a stern of a boat includes a mounting unit having a swivel shaft connected to a propeller to turn the propeller, and a swivel case rotatably accommodating the swivel shaft. A vibration attenuator is installed at a portion connecting an outboard motor main unit and the mounting unit and attenuating vibration of the outboard motor main unit to be transmitted to the mounting unit by causing the outboard motor main unit to displace relative to the mounting unit. In the system, displacement absorbers are installed at a portion connecting one of a main body and an output end of a steering actuator to the outboard motor main unit and another portion connecting the other of the main body and the output end to the mounting unit.

10 Claims, 8 Drawing Sheets

OUTBOARD MOTOR STEERING SYSTEM

BACKGROUND OF THE INVENTION

1. Field of the Invention

This invention relates to an outboard motor steering system.

2. Description of the Related Art

In almost all outboard motors, the outboard motor comprises an outboard motor main unit having an internal combustion engine and a propeller powered by the engine, and is mounted on a boat through a mounting unit having a swivel shaft (steering shaft) and a swivel case that accommodates the swivel shaft rotatably such that the outboard motor main unit is steered.

The swivel shaft is ordinarily rotated by human power, such as the tiller handle type used to turn the rudder by manually operating the tiller handle connected to the swivel shaft and the remote control type used to remotely operate a link mechanism connected to the swivel shaft through a push-pull cable in response to rotation of a steering wheel manipulated by the operator.

Since human-powered steering systems are disadvantageous because they tend to have an unpleasant steering "feel" owing to, for instance, heavy steering load, as taught in Japanese Laid-Open Patent Application Sho 62 (1987)-125996 ('996), an add-on mechanism constituted as a separate unit from the outboard motor and used to power-assist the turning of the steering wheel is known. This mechanism typically includes a steering actuator such as a hydraulic cylinder placed on the boat to power-assist the steering through a link mechanism. The add-on steering system using such an actuator also has disadvantages, most notably that it adds to the number and weight of the components, and that it takes up space on the boat.

Attempts have been made to overcome these drawbacks. Japanese Laid-Open Patent Application No. Hei 2(1990)-279495 ('495), for example, teaches a steering system including a steering hydraulic cylinder that is not attached to the boat, but directly attached to the mounting unit (more specifically its output end (piston rod) is connected to the swivel shaft or the outboard motor main unit, whilst its main body (cylinder) is connected to the swivel case), thereby minimizing increase in the number and weight of the constituent components and saving space.

Aside from the above, the outboard motor main unit may sometimes vibrate due to engine operation and resistance exerted on the propeller. It is therefore preferable to attenuate the vibration to be transmitted from the outboard motor main unit to the mounting unit so as to reduce vibration to be further transmitted to the boat. In view of this, it has been proposed to install a rubber member (as a vibration attenuator) at a portion connecting the outboard motor main unit and the mounting unit, thereby enabling the outboard motor to displace relative to the mounting unit such that the vibration to be transmitted from the outboard motor to the mounting unit attenuates, as taught in Honda Motor Company Service manual of Honda Outboard Motor BF115A/BF130A; pages 12–47 and 13–5; published on May, 1998.

As mentioned with reference to '996, the outboard motor main unit and the mounting unit are generally made displaceable to each other. Accordingly, as suggested by '495, if the actuator output end (or main body) is connected to the outboard motor main unit, whereas the actuator main body (or output end) is connected to the mounting unit, in other words, if the steering actuator is interposed at any location between the outboard motor and the mounting unit, excessive stress may act on the connection from the outboard motor main unit to the mounting unit via the actuator.

On the other hand, as suggested by '495, when the actuator output end is connected to the swivel shaft, whereas the actuator main body is connected to the swivel case, in other words, when the connection of the actuator is completed at the mounting unit by connecting the main body to the swivel case, this can avoid the disadvantage mentioned above. However, this also has disadvantage that its structure degrade the degree of freedom of installing position of the actuator.

SUMMARY OF THE INVENTION

An object of the present invention is therefore to overcome the foregoing issues by providing an outboard motor steering system that can interpose a steering actuator between an outboard motor main unit and a mounting unit, even when a vibration attenuator is installed at a portion connecting the outboard motor main unit and the mounting unit such that they are displaceable to each other so as to attenuate vibration of the outboard motor main unit, while improving the degree of freedom of installing position of the actuator.

In order to achieve the foregoing objects, this invention provides a steering system for an outboard motor mounted on a stern of a boat and including an outboard motor main unit having an internal combustion engine at its upper portion and a propeller with a rudder at its lower portion powered by the engine to propel and steer the boat, comprising: a mounting unit mounting the outboard motor main unit on the stern of the boat and having at least a swivel shaft connected to the propeller to turn the propeller relative to the boat, and a swivel case rotatably accommodating the swivel shaft; a vibration attenuator installed at a first connecting portion connecting the outboard motor main unit and the mounting unit and attenuating vibration of the outboard motor main unit to be transmitted to the mounting unit by causing the outboard motor main unit to displace relative to the mounting unit; an actuator rotating the swivel shaft to turn the propeller relative to the boat, the actuator having a main body and an output end to be movable from the main body, one of the main body and the output end of which being connected to the outboard motor main unit at a second connecting portion, whilst the other of the main body and the output end of which being connected to the mounting unit at a third connecting portion; and a displacement absorber installed at least one of the second connecting portion and the third connecting portion and absorbing the displacement of the outboard motor main unit relative to the mounting unit.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

An outboard motor steering system according to a first embodiment of the present invention will now be explained with reference to the attached drawings.

Figure 1:
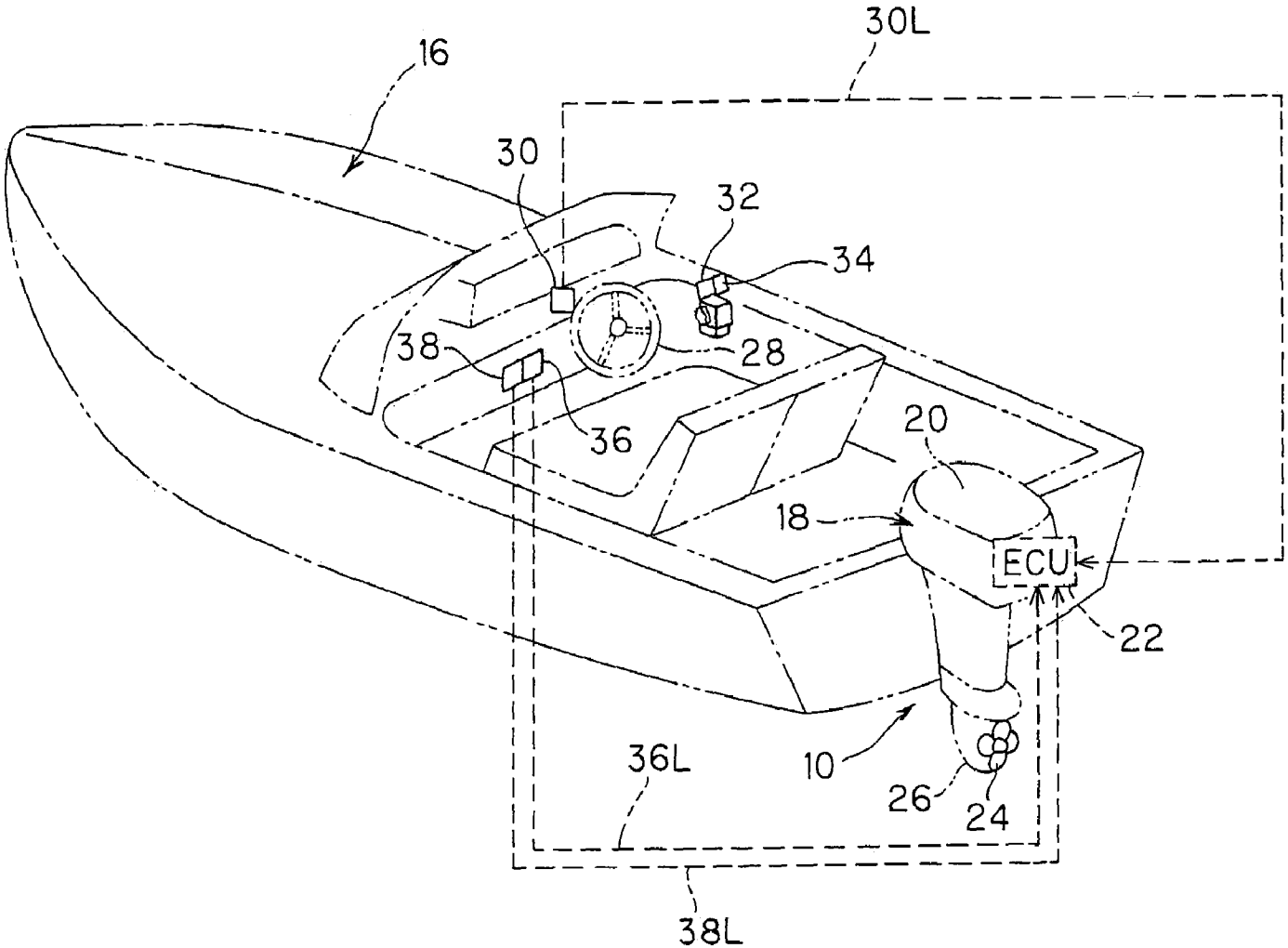
FIG. 1 is an overall schematic view of an outboard motor steering system according to a first embodiment of the invention.
Figure 2:
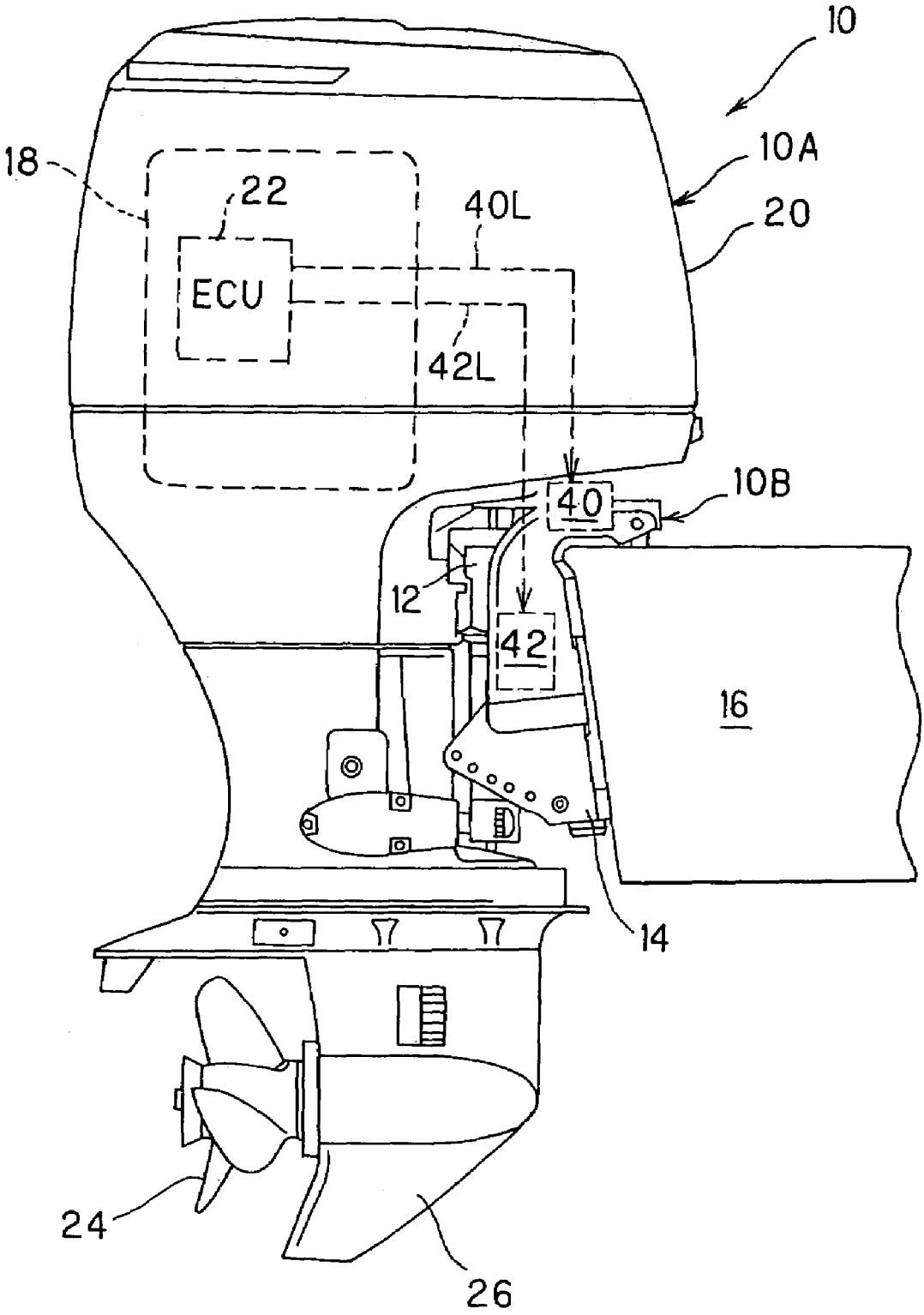
FIG. 2 is an explanatory side view of an outboard motor main unit and a mounting unit of FIG. 1.

FIG. 1 is an overall schematic view of the outboard motor steering system, and FIG. 2 is an explanatory side view of an outboard motor main unit and a mounting unit of FIG. 1.

Reference numeral 10 in FIGS. 1 and 2 designates an outboard motor. As illustrated in FIG. 2, the outboard motor 10 comprises an outboard motor main unit 10A built integrally of an internal combustion engine, propeller shaft, propeller and other components, and a mounting unit 10B connected to the outboard motor main unit 10A and mounting the outboard motor main unit 10A on the stern of a boat. The mounting unit 10B comprises a swivel shaft (not shown), a swivel case 12 (that rotatably accommodates or houses the swivel shaft) and stern brackets 14 (to which the swivel case 12 is connected), etc. The outboard motor main unit 10A is mounted on the stern of a boat (hull) 16, via the mounting unit 10B, to be steerable (rotatable) about the vertical and horizontal axes.

As shown in FIG. 2, the outboard motor main unit 10A is equipped with an internal combustion engine 18 at its upper portion. The engine 18 is a spark-ignition, in-line four-cylinder gasoline engine with a displacement of 2,200 cc. The engine 18, located inside the outboard motor 10, is enclosed by an engine cover 20 and positioned above the water surface. An electronic control unit (ECU) 22 constituted of a microcomputer is installed near the engine 18 enclosed by the engine cover 20.

The outboard motor main unit 10A is equipped at its lower part with a propeller 24 and a rudder 26 adjacent thereto. The rudder 26 is fixed near the propeller 24 and does not rotate independently. The propeller 24, which operates to propel the boat 16 in the forward and reverse directions, is powered by the engine 18 through a crankshaft, drive shaft, gear mechanism and shift mechanism (none of which is shown).

As shown in FIG. 1, a steering wheel 28 is installed near the operator's seat of the boat 16. A steering angle sensor 30 is installed near the steering wheel 28. The steering angle sensor 30 is made of a rotary encoder and outputs a signal in response to the turning (rotation) of the steering wheel 28 inputted by the operator. A throttle lever 32 and a shift lever 34 are mounted on the right side of the operator's seat. Operations inputted to these are transmitted to a throttle valve of the engine 18 and the shift mechanism (neither shown) through push-pull cables (not shown).

A power tilt switch 36 for regulating the tilt angle and a power trim switch 38 for regulating the trim angle of the outboard motor main unit 10A are also installed near the operator's seat. These switches output signals in response to tilt-up/down and trim-up/down instructions inputted by the operator. The outputs of the steering angle sensor 30, power tilt switch 36 and power trim switch 38 are sent to the ECU 22 over signal lines 30L, 36L and 38L.

As illustrated in FIG. 2, an actuator for steering, more specifically a steering hydraulic cylinder 40 to steer (to power-assist the steering) and a conventional power tilt-trim unit 42 for regulating the tilt angle and trim angle are installed at the mounting unit 10B, and are connected to the ECU 20 through signal lines 40L and 42L. In response to the output of sensors and switches, the ECU 22 operates the steering hydraulic cylinder 40 to steer the outboard motor and the power tilt-trim unit 42 to regulate the tilt angle and trim angle of the outboard motor 10.

Figure 3:
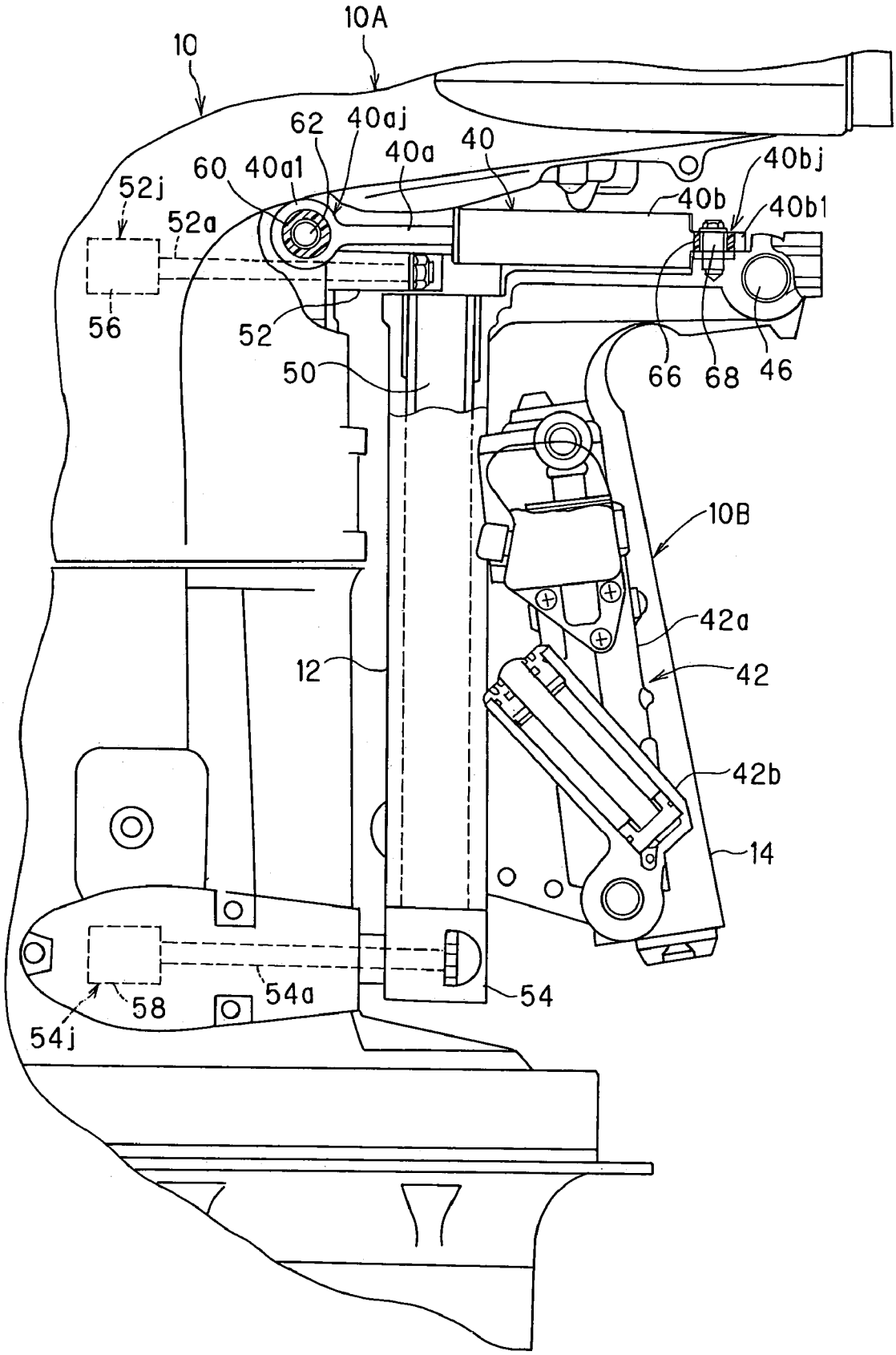
FIG. 3 is an enlarged partial cross-sectional view of portions around the mounting unit illustrated in FIG. 2.

FIG. 3 is an enlarged partial cross-sectional view of portions around the mounting unit 10B illustrated in FIG. 2.

As illustrated in FIG. 3, the power tilt-trim unit 42 is equipped with one hydraulic cylinder 42*a* for tilt angle regulation and, constituted integrally therewith, two hydraulic cylinders 42*b* for trim angle regulation (only one shown). One end (cylinder bottom) of the tilt hydraulic cylinder 42*a* is fastened to the stern brackets 14 and through it to the boat 16 and the other end (piston rod head) thereof abuts on the swivel case 12. One end (cylinder bottom) of each trim hydraulic cylinder 42*b* is fastened to the stern brackets 14 and through it to the boat 16, similarly to the one end of the tilt hydraulic cylinder 42*a*, and the other end (piston rod head) thereof abuts on the swivel case 12.

The swivel case 12 is connected to the stern brackets 14 through a tilting shaft 46 to be relatively displaceable about the tilting shaft 46. As mentioned above, the swivel shaft (now assigned with reference numeral 50) is rotatably accommodated inside the swivel case 12. The swivel shaft 50 extends in the vertical direction and has its upper end fastened to a mount frame 52 and its lower end fastened to a lower mount center housing 54.

As illustrated in the figure, a hexagonal headed bolt 52*a* is provided inside the mount frame 52. The bolt 52*a* is connected to the outboard motor main unit 10A through an elastic member, i.e., an upper mount rubber member 56. Similarly, a hexagonal headed bolt 54*a* is provided inside the lower mount center housing 54. The bolt 54*a* is connected to the outboard motor main unit 10A through an elastic member, i.e., a lower mount rubber member 58. A portion connecting the mount frame 52 and the outboard motor main unit 10A, more specifically a portion connecting the bolt 52*a* and the outboard motor main unit 10A is herein after referred to an "upper side connecting portion" and is assigned with reference numeral 52*j*. A portion connecting the lower mount center housing 54 and the outboard motor main unit 10A, more specifically a portion connecting the bolt 54*a* and the outboard motor main unit 10A is herein after referred to a "lower side connecting portion" and is assigned with reference numeral 54*j*.

Thus, the upper mount rubber member 56 is installed at the upper side connecting portion 52*j* that connects the mount frame 52 to the outboard motor main unit 10A, whilst the lower mount rubber member 58 is installed at the lower side connecting portion 54*j* that connects the lower mount center housing 54 to the outboard motor main unit 10A. With this, if the outboard motor main unit 10A vibrates, the upper mount rubber member 56 and the lower mount rubber member 58 deform such that the outboard motor main unit 10A and the mounting unit 10B displace to each other, thereby enabling to attenuate the vibration to be transmitted from the outboard motor main unit 10A and to decrease or attenuate vibration to be further transmitted to the boat 16. The aforesaid steering hydraulic cylinder 40 is installed at a position above the swivel case 12.

Figure 4:
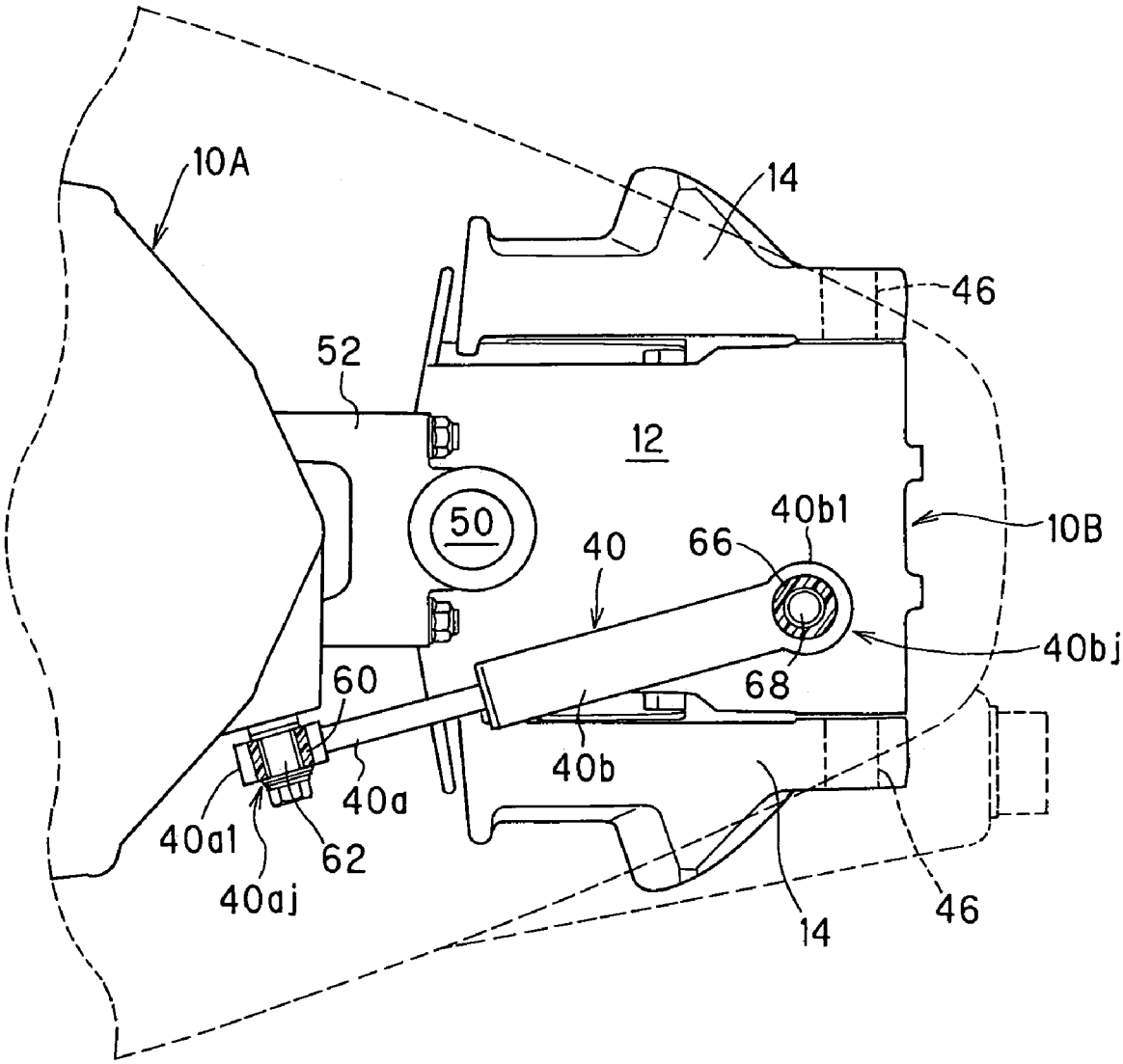
FIG. 4 is a plan view of portions around the mounting unit illustrated in FIG. 2 and viewed from the above.

FIG. 4 is a plan view of portions around the mounting unit 10B viewed from the above.

As illustrated in FIGS. 3 and 4, the steering hydraulic cylinder 40 is installed at the position in such a way that its output end, more precisely a rod head 40*a*1 of a piston rod 40*a* is connected to the outboard motor main unit 10A, whilst its main body, precisely a cylinder 40*b*, more precisely a cylinder bottom 40*b*1 of the cylinder 40*b* is connected to the swivel case 12 of the mounting unit 10B. Thus, the steering hydraulic cylinder (actuator) 40 has the main body and the output end to be movable from the main body.

Figure 5:
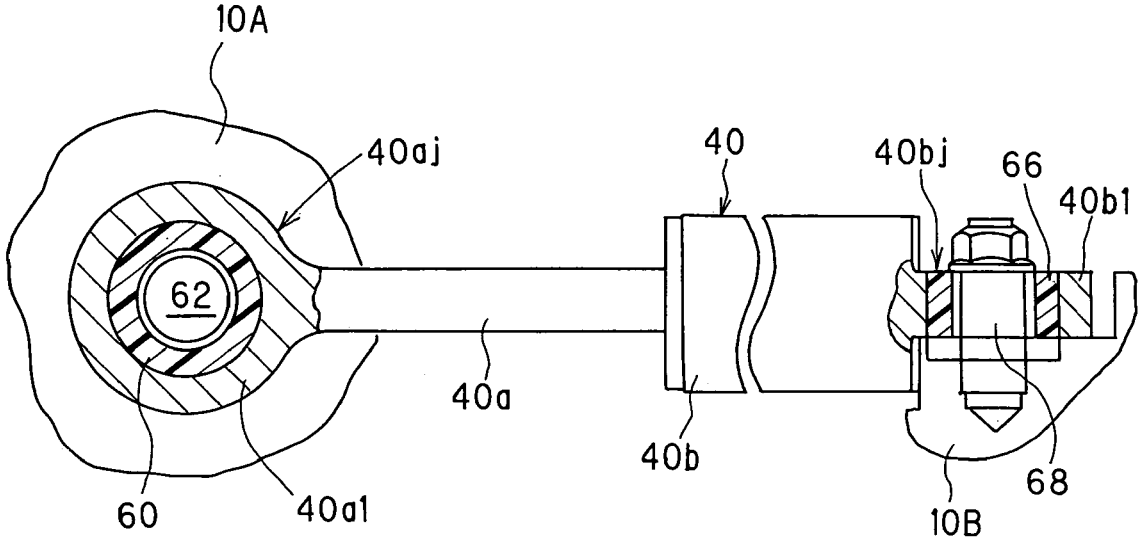
FIG. 5 is an enlarged partial cross-sectional view of portions around a steering hydraulic cylinder illustrated in FIG. 3.
Figure 6:
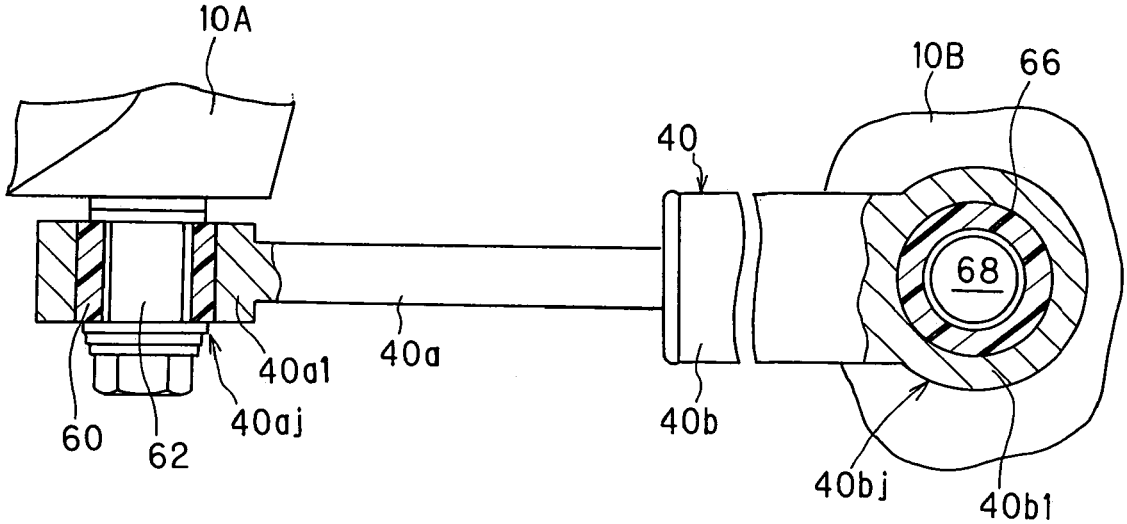
FIG. 6 is a similar enlarged partial cross-sectional view of the portions around the steering hydraulic cylinder illustrated in FIG. 4.

FIG. 5 is an enlarged partial cross-sectional view of portions around the steering hydraulic cylinder 40 illustrated in FIG. 3; and FIG. 6 is a similar enlarged partial cross-sectional view of the portions around the steering hydraulic cylinder 40 illustrated in FIG. 4.

As is best shown in FIGS. 4 and 5, the rod head 40*a*1 is rotatably connected to a cylindrical member 62 (hereinafter referred to as "rod head side cylindrical member") fastened to the outboard motor main unit 10A, through an elastic member, i.e., a rubber member 60 having a doughnut-like or cylindrical shape (hereinafter referred to as "rod head side rubber member"). Similarly, the cylinder bottom 40*b*1 is rotatably connected to a cylindrical member 68 (hereinafter referred to as "cylinder bottom side cylindrical member") fastened to an upper portion of the swivel case 12, through an elastic member, i.e., a rubber member 66 also having a doughnut-like or cylindrical shape (hereinafter referred to as "cylinder bottom side rubber member"). A portion connecting the cylinder rod head 40*a*1 and the outboard motor main unit 10A is hereinafter referred to as "rod head side connecting portion" and assigned with reference numeral 40*aj*. Similarly, a portion connecting the cylinder bottom 40*b*1 and the mounting unit 10B is hereinafter referred to as "cylinder bottom side connecting portion" and assigned with reference numeral 40*bj*.

Then, steering of the outboard motor 10A will be explained.

When the operator steers the steering wheel 28, the amount of steering (the amount of rotation of the steering wheel 28) is detected by the steering angle sensor 30 and is inputted to the ECU 22. The ECU 22 determines or calculates a current supply command in response to the inputted amount of steering (a command to steer) and outputs the same to a driver circuit of an electric motor (not shown) to drive a hydraulic pump through the hydraulic circuit such that the steering hydraulic cylinder 40 extends or contracts to rotate the swivel shaft 50.

Specifically, by operating the steering hydraulic cylinder 40 to extend or contract, the steering of the outboard motor 10 in the horizontal direction about the swivel shaft 50 is power-assisted and the propeller 24 (and the rudder 26) is swung to steer the boat 16. More specifically, the swivel shaft 50 and mount frame 52 are rotated right (viewed from the above) relative to the boat 16 when the steering hydraulic cylinder 40 is driven to extend, and the outboard motor 10 is steered right such that the boat 16 is steered left (viewed from the above). On the contrary, when the steering hydraulic cylinder 40 is driven to contract, the swivel shaft 50 and mount frame 52 rotate left to steer the outboard 10 left such that the boat 16 is steered. In this embodiment, the overall steerable angle (rudder turning angle) of the outboard motor 10 is 60 degrees, 30 degrees to the right and 30 degrees to the left.

As stated above, the outboard motor steering system according to this embodiment is arranged such that, the rod head 40*a*1 of the steering hydraulic cylinder (steering actuator) 40 is connected to the outboard motor main unit 10A, whilst the cylinder bottom 40*b*1 of the steering hydraulic cylinder 40 is connected to the mounting unit 10B. And the rod head side rubber member (elastic member) 60 is installed at the rod head side connecting portion 40*aj* that connects the rod head 40*a*1 of the steering hydraulic cylinder 40 and the outboard motor main unit 10A, whilst the cylinder bottom side rubber member (elastic member) 66 is installed at the cylinder bottom side connecting portion 40*bj* that connects the cylinder bottom 40*b*1 of the steering hydraulic cylinder 40 and the mounting unit 10B.

With this, when the upper and lower mount rubber members 56 and 58 (each acting as the vibration attenuator) are respectively installed at the upper side connecting portion 52*j* and the lower side connecting portion 54*j* each connecting the outboard motor main unit 10A and the mounting unit 10B in such a manner that the outboard motor main unit 10A and the mounting unit 10B are made displaceable to each other such that the vibration generated at the outboard motor main unit 10A and to be transmitted to the mounting unit 10B attenuates, the displacement can be absorbed by deformation of the rod head side rubber member 60 and the cylinder bottom side rubber member 66 (each acting as a displacement absorber), thereby enabling to prevent excessive stress from exerting or imparting on the connection from the outboard motor main unit 10A to the mounting unit 10B via the steering hydraulic cylinder 40.

Accordingly, in case that the vibration attenuators (the upper and lower mount rubber members 56 and 58) are respectively installed at the upper side connecting portion 52*j* and the lower side connecting portion 54*j* each connecting the outboard motor main unit 10A and the mounting unit 10B, the steering hydraulic cylinder (steering actuator) 40 can still be interposed at any location between the outboard motor main unit 10A and the mounting unit 10B, thereby enabling to enhance the degree of freedom of installing position of the steering hydraulic cylinder 40.

Further, since the displacement absorbers (the rod head side rubber member 60 and the cylinder bottom side rubber member 66) that absorb the displacement of the outboard motor 10A relative to the mounting unit 10B are only made up of elastic members, the structure can be simplified.

An outboard motor steering system according to a second embodiment of the invention will be explained with reference to FIGS. 7 and 8.

Figure 7:
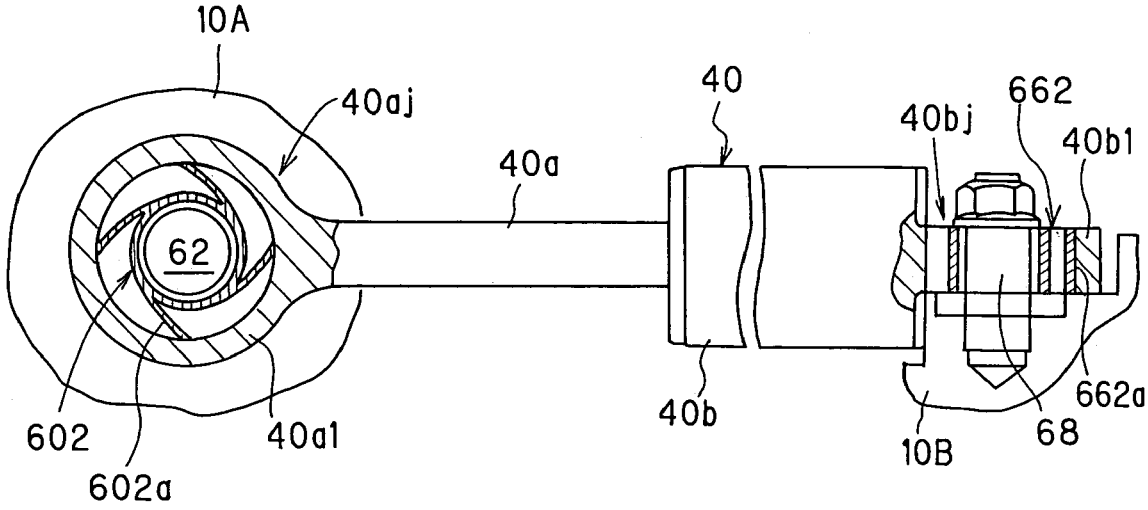
FIG. 7 is a view, similar to FIG. 5, but showing portions around the steering hydraulic cylinder according to a second embodiment of the invention.
Figure 8:
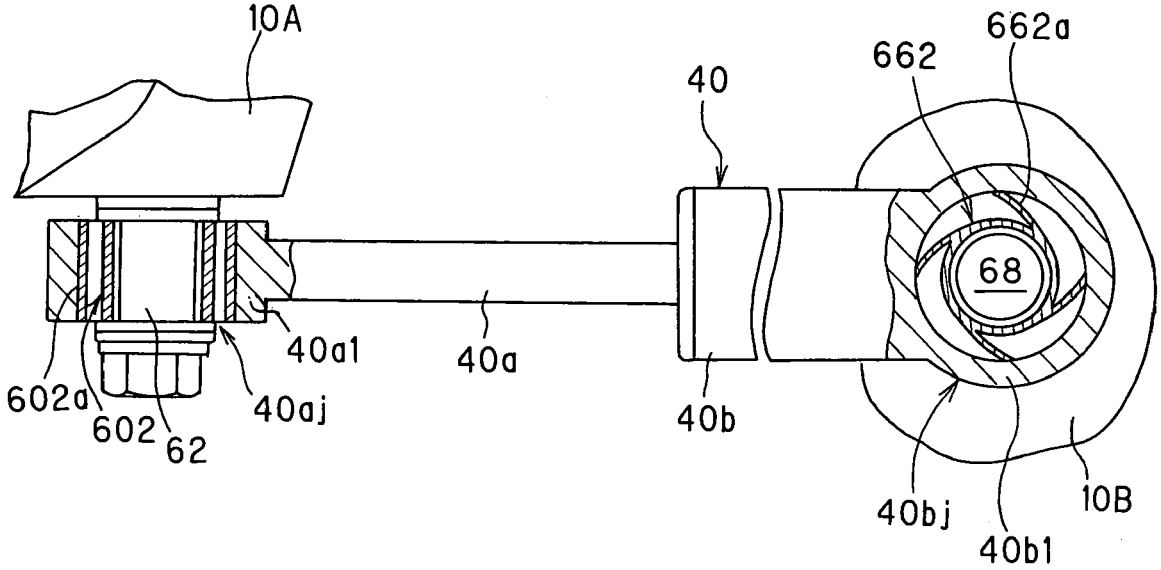
FIG. 8 is a view, similar to FIG. 6, and similarly showing the portions around the steering hydraulic cylinder according to the second embodiment.

FIG. 7 is a view, similar to FIG. 5, but showing portions around the steering hydraulic cylinder 40 according to the second embodiment; and FIG. 8 is a view, similar to FIG. 6, and similarly showing the portions around the steering hydraulic cylinder 40 according to the second embodiment.

Explaining this with focus on the differences from the first embodiment, in the outboard motor steering system according to the second embodiment, springs are used as the displacement absorber.

To be more specific, as illustrated in the figures, a spring 602 (hereinafter referred to as "rod head side spring") is interposed or installed between the rod head 40*a*1 of the steering hydraulic cylinder 40 and the rod head side cylindrical member 62 fastened to the outboard motor main unit 10A. The rod head side spring 602 has a plurality of (i.e. four) biasing force generators 602*a* extend outwardly from the outer periphery (surface) of the rod head side cylindrical member 62 in an arc (when viewed from the above in FIG. 7) and at regular intervals of 90 degrees. The biasing force generators 602*a* are brought into contact with the inner periphery (surface) of the rod head 40*a*1 at their distal ends and generate biasing force between the rod head 40*a*1 and the rod head cylindrical member 62.

Similarly, another spring 662 (hereinafter referred to as "cylinder bottom side spring") is interposed or installed between the cylinder bottom 40*b*1 of the steering hydraulic cylinder 40 and the cylinder bottom side cylindrical member 68 fastened to the mounting unit 10B. Also, the cylinder bottom side spring 662 has a plurality of (i.e. four) biasing force generators 662*a* extend outwardly from the outer periphery (surface) of the cylinder bottom side cylindrical member 68 in an arc (when viewed from the above in FIG. 8) and at regular intervals of 90 degrees. The biasing force generators 662*a* are brought into contact with the inner periphery (surface) of the cylinder bottom 40*b*1 at their distal ends and generate biasing force between the cylinder bottom 40*b*1 and the cylinder bottom side cylindrical member 68.

With this, when no displacement occurs between the outboard motor 10A and the mounting outboard motor main unit 10B, by the biasing force generated by the biasing force generators 602*a* and 662*a*, the rod head side cylindrical member 62 is urged towards the center of the rod head 40*a*1, whilst the cylinder bottom side cylindrical member 68 is urged towards the center of the cylinder bottom 40*b*1. On the other hands, when displacement occurs between the outboard motor 10A and the mounting unit 10B, any of the biasing force generator corresponding to the direction of displacement deforms and absorbs the displacement of the outboard motor main unit 10A relative to the mounting unit 10B, thereby enabling to prevent excessive stress from exerting on the connection from the outboard motor 10A to the mounting unit 10B via the steering hydraulic cylinder 40.

As mentioned above, the outboard motor steering system according to the second embodiment is arranged such that, the rod head side spring (elastic member) 602 is installed at the rod head side connecting portion 40*aj* that connects the rod head 40*a*1 of the steering hydraulic cylinder 40 and the outboard motor main unit 10A, whilst the cylinder bottom side spring (elastic member) 662 is installed at the cylinder bottom side connecting portion 40*bj* that connects the cylinder bottom 40*b*1 of the steering hydraulic cylinder 40 and the mounting unit 10B. With this, the displacement can be absorbed by deformation of the biasing force generators 602*a* and 662*a*, thereby enabling to prevent excessive stress from exerting or imparting on the connection from the outboard motor main unit 10A to the mounting unit 10B via the steering hydraulic cylinder 40.

Accordingly, in case that the vibration attenuators (the upper and lower mount rubber members 56 and 58) are respectively installed at the upper side connecting portion 52*j* and the lower side connecting portion 54*j* each connecting the outboard motor main unit 10A and the mounting unit 10B, the steering hydraulic cylinder (steering actuator) 40 can still be interposed at any location between the outboard motor main unit 10A and the mounting unit 10B, thereby enabling to enhance the degree of freedom of installing position of the steering hydraulic cylinder 40.

Further, since the displacement absorbers (the rod head side spring 602 and the cylinder bottom side spring 662) that absorb the displacement of the outboard motor main unit 10A relative to the mounting unit 10B are only made up of springs, the structure can be simplified.

Since the rest of the structure is not different from the first embodiment, the same reference numerals are used here and the explanation thereon is omitted.

An outboard motor steering system according to a third embodiment of the invention will be explained with reference to FIGS. 9 and 10.

Figure 9:
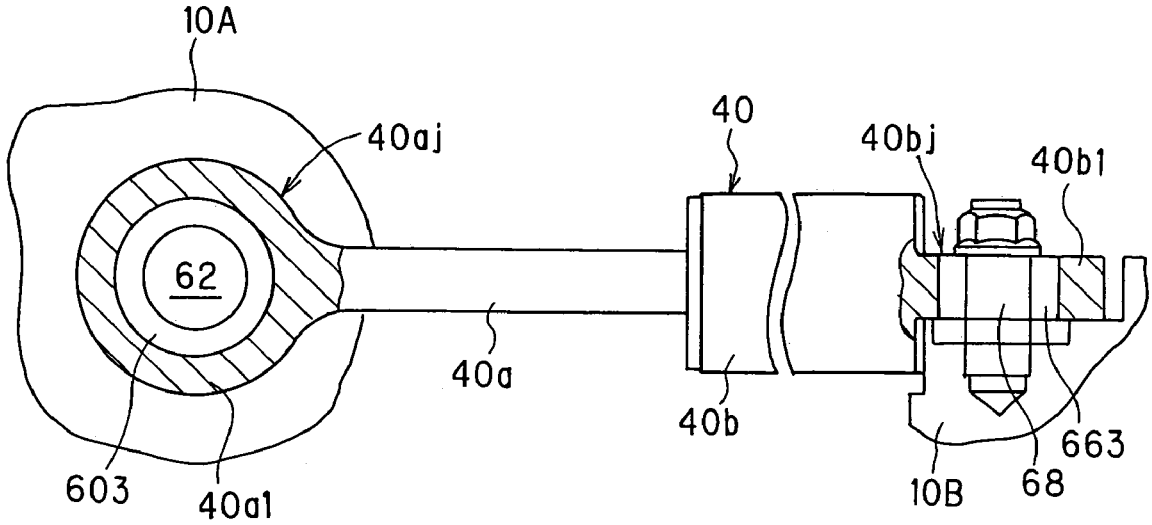
FIG. 9 is a view, similar to FIG. 5, but showing portions around the steering hydraulic cylinder according to a third embodiment of the invention.
Figure 10:
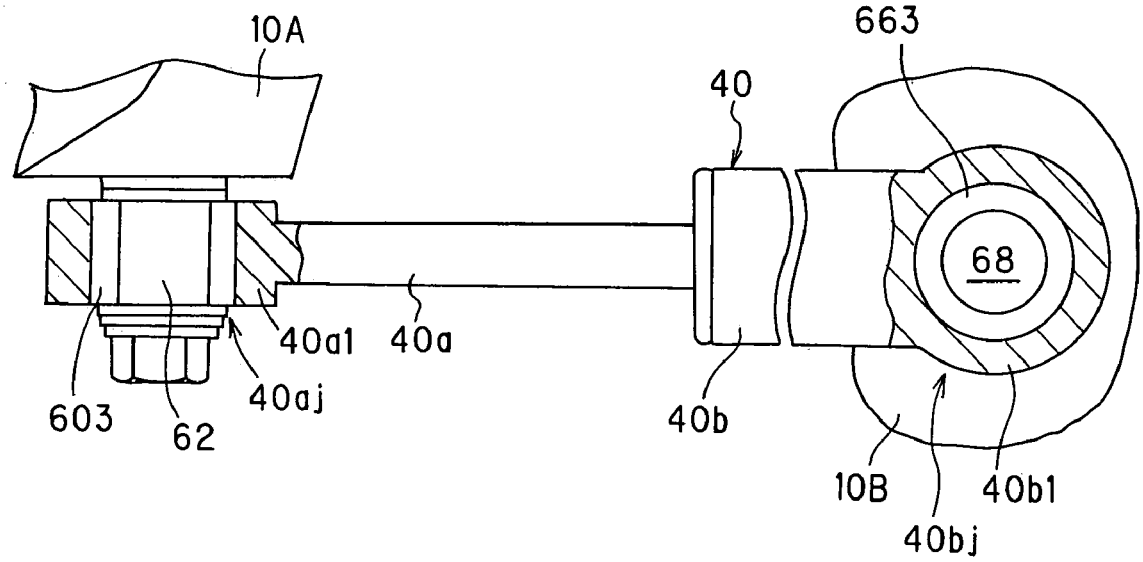
FIG. 10 is a view, similar to FIG. 6, and similarly showing the portions around the steering hydraulic cylinder according to the third embodiment.

FIG. 9 is a view, similar to FIG. 5, but showing portions around the steering hydraulic cylinder 40 according to the third embodiment; and FIG. 10 is a view, similar to FIG. 6, and similarly showing the portions around the steering hydraulic cylinder 40 according to the third embodiment.

Explaining this with focus on the differences from the first embodiment, in the outboard motor steering system according to the third embodiment, gaps are used as the displacement absorber.

To be specific, as illustrated in the figures, a gap 603 (hereinafter referred to as "rod head side gap") is interposed or formed between the rod head 40*a*1 of the steering hydraulic cylinder 40 and the rod head side cylindrical member 62 fastened to the outboard motor main unit 10A. More specifically, the (outer) diameter of the rod head side cylindrical member 62 is decreased than the inner diameter of the rod head 40*a*1 by a predetermined amount (e.g., 4 mm to 6 mm) to form the rod head side gap 603 in a doughnut-like or cylindrical shape having a predetermined width (e.g., 2 mm to 3 mm) therebetween.

Similarly, another gap 663 (hereinafter referred to as "cylinder bottom side gap") is interposed or formed between the cylinder bottom 40*b*1 of the steering hydraulic cylinder 40 and the cylinder bottom side cylindrical member 68 fastened to the mounting unit 10B. Also, the (outer) diameter of the cylinder bottom side cylindrical member 68 is decreased than the inner diameter of the cylinder bottom 40*b*1 by a predetermined amount (e.g., 4 mm to 6 mm) to form the cylinder bottom side gap 663 in a doughnut-like or cylindrical shape having a predetermined width (e.g., 2 mm to 3 mm) therebetween.

With this, when displacement occurs between the outboard motor 10A and the mounting unit 10B, the rod head side cylindrical member 62 can displace or move inside the rod head 40*a*1, whilst the cylinder bottom side cylindrical member 68 can displace or move inside the cylinder bottom 40*b*1, thereby enabling to prevent excessive stress from exerting on the connection from the outboard motor 10A to the mounting unit 10B via the steering hydraulic cylinder 40.

As mentioned above, the outboard motor steering system according to the third embodiment is arranged such that, the rod head side gap 603 is formed at the rod head side connecting portion 40*aj* that connects the rod head 40*a*1 of the steering hydraulic cylinder 40 and the outboard motor main unit 10A, whilst the cylinder bottom side gap 663 is formed at the cylinder bottom side connecting portion 40*bj* that connects the cylinder bottom 40*b*1 of the steering hydraulic cylinder 40 and the mounting unit 10B. With this, the displacement can be absorbed by the gaps 603 and 663, thereby enabling to prevent excessive stress from exerting or imparting on the connection from the outboard motor main unit 10A to the mounting unit 10B via the steering hydraulic cylinder 40.

Accordingly, in case that the vibration attenuators (the upper and lower mount rubber members 56 and 58) are respectively installed at the upper side connecting portion

52*j* and the lower side connecting portion 54*j* each connecting the outboard motor main unit 10A and the mounting unit 10B, the steering hydraulic cylinder (steering actuator) 40 can still be interposed at any location between the outboard motor main unit 10A and the mounting unit 10B, thereby enabling to enhance the degree of freedom of installing position of the steering hydraulic cylinder 40.

Further, since the displacement absorbers (the rod head side gap 603 and the cylinder bottom side gap 663) that absorb the displacement of the outboard motor 10A relative to the mounting unit 10B need no additional member, the structure can be simplified.

Since the rest of the structure is not different from the first embodiment, the same reference numerals are used here and the explanation thereon is omitted.

An outboard motor steering system according to a fourth embodiment of the invention will be explained with reference to FIG. 11.

Figure 11:
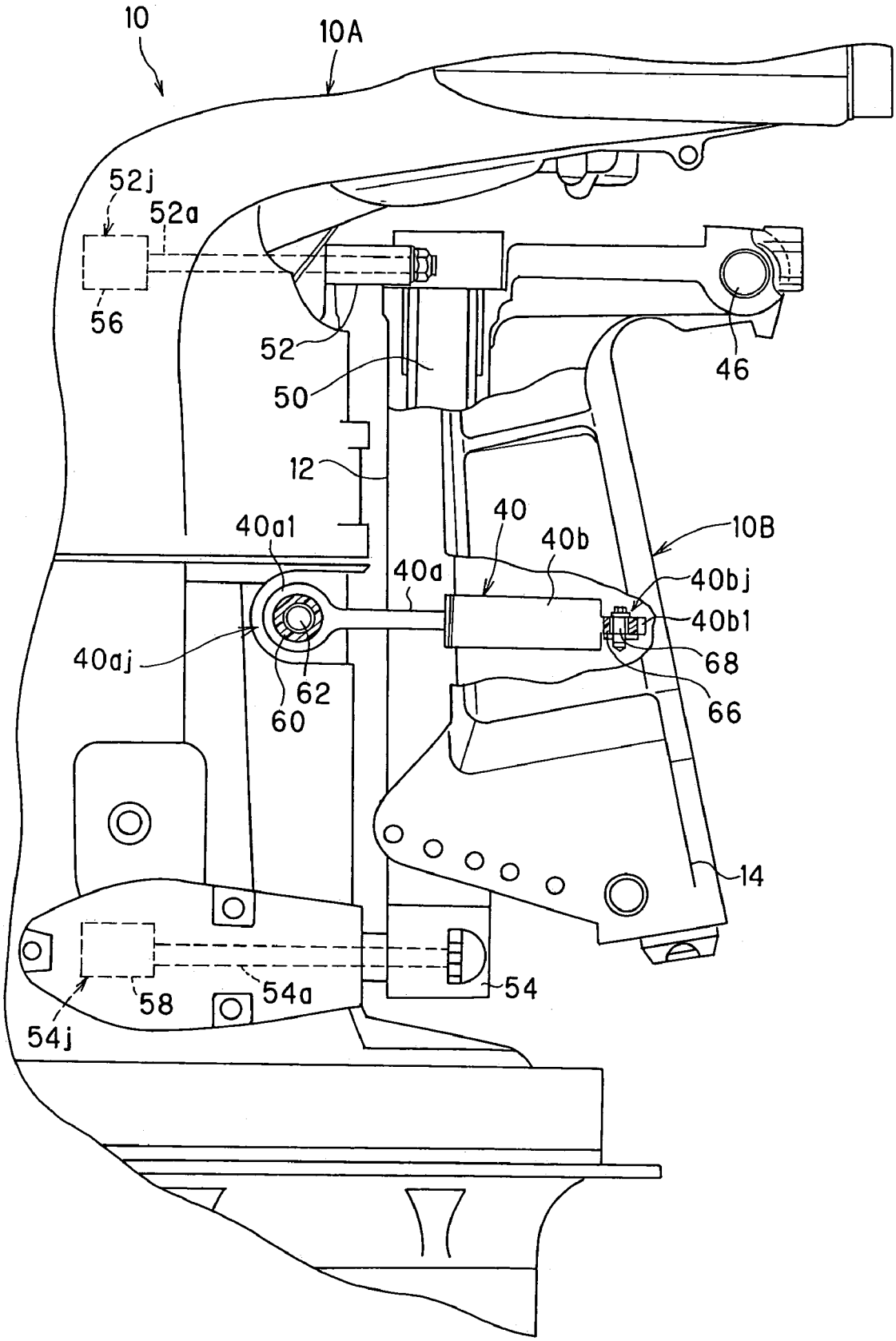
FIG. 11 is a view, similar to FIG. 3, but showing portions around the mounting unit according to a fourth embodiment of the invention.

FIG. 11 is a view, similar to FIG. 3, but showing portions around the mounting unit 10B according to the fourth embodiment.

Explaining this with focus on the differences from the first embodiment, in the outboard motor steering system according to the fourth embodiment, the steering hydraulic cylinder 40 is located or installed at a position midway of the mount frame 52 and the lower mount center housing 54, more precisely at the middle or thereabout between the mount frame 52 and the lower mount center housing 54.

To be specific, as illustrated in the figure, the steering hydraulic cylinder 40 is installed or interposed at the middle position or thereabout between the upper side connecting portion 52*j* that connects the mount frame 52 and the outboard motor main unit 10A and the lower side connecting portion 54*j* that connects the lower mount center housing 54 and the outboard motor main unit 10A, such that the rod head side connecting portion 40*aj* and the cylinder bottom side connecting portion 40*bj* are installed or interposed at the middle position or thereabout between the upper side connecting portion 52*j* and the lower side connecting portion 54*j*. The rod head side rubber member 60 and the cylinder bottom side rubber member 66 mentioned in the first embodiment are at the rod head side connecting portion 40*aj* and the cylinder bottom side connecting portion 40*bj* as the displacement absorbers.

As mentioned above, since the upper mount rubber member 56 and the lower mount rubber member 58 are installed at the upper side connecting portion 52*j* and the lower side connecting portion 54*j*, the outboard motor main unit 10A displaces, relative to the mounting unit 10B, at the middle position (or thereabout) between the upper side connecting portion 52*j* and the lower side connecting portion 54*j*.

Accordingly, the amount of displacement of the outboard motor main unit 10A relative to the mounting unit 10B becomes least (decreases) at the middle position (or thereabout) between the upper side connecting portion 52*j* and the lower side connecting portion 54*j*. For that reason, it becomes possible to decrease the stress exerting on the rod head side connecting portion 40*aj* and the cylinder bottom side connecting portion 40*bj*, by installing the steering hydraulic cylinder 40 at the middle (or thereabout) between the upper side connecting portion 52*j* and the lower side connecting portion 54*j*.

With this, in addition to the advantages and effects mentioned in the foregoing embodiments, it becomes possible to mitigate or decrease degradation or deterioration of the rubber members 60 and 66.

Further, since the capacity of the rubber members 60 and 66 for absorbing the stress can be made smaller, it becomes possible to make the rubber members 60 and 66 smaller and hence, make the structure simpler.

Since the rest of the structure is not different from the first embodiment, the same reference numerals are used here and the explanation thereon is omitted.

The first to fourth embodiments are thus arranged to have a steering system for an outboard motor 10 mounted on a stern of a boat 16 and including an outboard motor main unit 10A having an internal combustion engine 18 at its upper portion and a propeller 24 with a rudder 26 at its lower portion powered by the engine to propel and steer the boat, comprising: a mounting unit 10B mounting the outboard motor main unit on the stern of the boat and having at least a swivel shaft 50 connected to the propeller to turn the propeller relative to the boat, and a swivel case 12 rotatably accommodating the swivel shaft; a vibration attenuator (upper mount rubber member 56, lower mount rubber member 58) installed at a first connecting portion (upper side connecting portion 52*j*, lower side connecting portion 54*j*) connecting the outboard motor main unit 10A and the mounting unit 10B and attenuating vibration of the outboard motor main unit to be transmitted to the mounting unit by causing the outboard motor main unit to displace relative to the mounting unit; an actuator (steering hydraulic cylinder 40) rotating the swivel shaft to turn the propeller relative to the boat, the actuator having a main body (cylinder 40*b*, more precisely cylinder bottom 40*b*1) and an output end to be movable from the main body (piston rod 40*a*, more precisely rod head 40*a*1), one of the main body and the output end of which being connected to the outboard motor main unit 10A at a second connecting portion (rod head side connecting portion 40*aj*), whilst other of the main body and the output end of which being connected to the mounting unit 10B at a third connecting portion (cylinder bottom side connecting portion 40*bj*); and a displacement absorber (rod head side rubber member 60, cylinder bottom side rubber member 66, rod head side spring 602, cylinder bottom side spring 662, rod head side gap 603, cylinder bottom side gap 663) installed at least one (more specifically each) of the second connecting portion and the third connecting portion and absorbing the displacement of the outboard motor main unit 10A relative to the mounting unit 10B.

In the system, the displacement absorber comprises an elastic member (rod head side rubber member 60, cylinder bottom side rubber member 66), more specifically the displacement absorbers comprise the elastic members.

In the system, the displacement absorber comprises a spring (rod head side spring 602, cylinder bottom side spring 662, more precisely their biasing force generators 602*a*, 662*a*), more specifically, the displacement absorbers comprise the springs.

In the system, at least one (more precisely each) of a first member (rod head side cylindrical member 62) fastened to the outboard motor main unit 10A and at least one of the output end and the main body of the actuator (specifically the output, more specifically the rod head 40*a*1) and a second member (cylinder bottom side cylindrical member 68) fastened to the mounting unit 10B and at least one of the output end and the main body of the actuator (specifically the main body, more specifically the cylinder bottom 40*b*1) are formed with a gap (rod head side gap 603, cylinder bottom side gap 663) therebetween that acts as the displacement absorber.

In the system, the first connecting portion comprises an upper side connecting portion 52*j* located at an upper position of the mounting unit 10B and a lower side connecting portion 54*j* located at a lower position of the mounting unit 10B such that the displacement absorber is each installed at the upper side connecting portion 52*j* and the lower side connecting portion 54*j*, and the actuator is located at a position midway (more precisely middle or thereabout) of the upper side connecting portion 52*j* and the lower side connecting portion 54*j* in such a manner that the second connecting portion and the third connecting portion are located at the position midway (more precisely middle or thereabout) of the upper side connecting portion 52*j* and the lower side connecting portion 54*j* such that an amount of the displacement decreases.

It should be noted in the above that, although the hydraulic cylinder is used as the actuator to rotate the swivel shaft 50, the invention should not be limited thereto and a hydraulic motor, an electric motor or some similar factors may be used as the actuator.

It should also be noted in the above that, although the rod head 40*a*1 of the steering hydraulic cylinder 40 and the outboard motor main unit 10A, and the cylinder bottom 40*b*1 and the mounting unit 10B (more specifically the swivel case 12) are respectively connected by the cylindrical members 62 and 68, it is alternatively possible to connect them by a ball joint or some similar factors.

It should further be noted in the above that, although the displacement absorber installed at the rod head side connecting portion 40*aj* and the cylinder bottom side connecting portion 40*bj* are made the same, it is alternatively possible to make the absorbers different from each other. For example, the rod head side connecting portion 40*aj* is installed with the rod head side rubber member 60, but the cylinder bottom side connecting portion 40*bj* may be installed with cylinder bottom side spring 662. Further, the displacement absorber may be installed at only one of the rod head side connecting portion 40*aj* and the cylinder bottom side connecting portion 40*bj*.

It should further be noted in the above that, the rod head side rubber member 60 and the cylinder bottom side rubber member 66 are used in the fourth embodiment as the absorber for absorbing the displacement of the outboard motor main unit 10A relative to the mounting unit 10B, the rod head side spring 602 and the cylinder bottom side spring 662 may instead be used, or the rod head side gap 603 and the cylinder bottom side gap 663 may instead be formed (used).

If the springs 602 and 662 are used, since the capacity of the springs for absorbing the stress can be made smaller, it becomes possible to make them smaller and hence, make the structure simpler. If the gaps 603 and 663 are formed, since the width can be made smaller, it becomes possible to decrease plays and hence, to improve the steering feeling.

The entire disclosure of Japanese Patent Application No. 2003-040835, filed on Feb. 19, 2003, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A steering system for an outboard motor mounted on a stern of a boat and including an outboard motor main unit having an internal combustion engine at its upper portion and a propeller with a rudder at its lower portion powered by the engine to propel and steer the boat, comprising:

a mounting unit mounting the outboard motor main unit on the stern of the boat and having at least a swivel shaft connected to the propeller to turn the propeller relative to the boat, and a swivel case rotatably accommodating the swivel shaft;

a vibration attenuator installed at a first connecting portion connecting the outboard motor main unit and the mounting unit and attenuating vibration of the outboard motor main unit to be transmitted to the mounting unit by causing the outboard motor main unit to displace relative to the mounting unit;

an actuator rotating the swivel shaft to turn the propeller relative to the boat, the actuator having a main body and an output end to be movable from the main body, one of the main body and the output end of which being connected to the outboard motor main unit at a second connecting portion, whilst other of the main body and the output end of which being connected to the mounting unit at a third connecting portion; and a displacement absorber installed at least one of the second connecting portion and the third connecting portion and absorbing the displacement of the outboard motor main unit relative to the mounting unit.

2. A system according to claim 1, wherein the displacement absorber comprises an elastic member.

3. A system according to claim 1, wherein the displacement absorber comprises a spring.

4. A system according to claim 1, wherein at least one of a first member fastened to the outboard motor main unit and at least one of the output end and the main body of the actuator and a second member fastened to the mounting unit and at least one of the output end and the main body of the actuator are formed with a gap therebetween that acts as the displacement absorber.

5. A system according to claim 1, wherein the first connecting portion comprises an upper side connecting portion located at an upper position of the mounting unit and a lower side connecting portion located at a lower position of the mounting unit such that the displacement absorber is each installed at the upper side connecting portion and the lower side connecting portion, and the actuator is located at a position midway of the upper side connecting portion and the lower side connecting portion in such a manner that the second connecting portion and the third connecting portion are located at the position midway of the upper side connecting portion and the lower side connecting portion such that an amount of the displacement decreases.

6. A steering system for an outboard motor mounted on a stern of a boat and including an outboard motor main unit having an internal combustion engine at its upper portion and a propeller with a rudder at its lower portion powered by the engine to propel and steer the boat, comprising:

a mounting unit mounting the outboard motor main unit on the stern of the boat and having at least a swivel shaft connected to the propeller to turn the propeller relative to the boat, and a swivel case rotatably accommodating the swivel shaft;

a vibration attenuator installed at a first connecting portion connecting the outboard motor main unit and the mounting unit and attenuating vibration of the outboard motor main unit to be transmitted to the mounting unit by causing the outboard motor main unit to displace relative to the mounting unit;

an actuator rotating the swivel shaft to turn the propeller relative to the boat, the actuator having a main body and an output end to be movable from the main body, one of the main body and the output end of which being connected to the outboard motor main unit at a second connecting portion, whilst other of the main body and the output end of which being connected to the mounting unit at a third connecting portion; and displacement absorbers installed at the second connecting portion and the third connecting portion and absorbing the displacement of the outboard motor main unit relative to the mounting unit.

7. A system according to claim 6, wherein the displacement absorbers comprise elastic members.

8. A system according to claim 6, wherein the displacement absorbers comprise springs.

9. A system according to claim 6, wherein a first member fastened to the outboard motor main unit and at least one of the output end and the main body of the actuator and a second member fastened to the mounting unit and at least one of the output end and the main body of the actuator are formed with gaps therebetween that act as the displacement absorbers.

10. A system according to claim 6, wherein the first connecting portion comprises an upper side connecting portion located at an upper position of the mounting unit and a lower side connecting portion located at a lower position of the mounting unit such that the displacement absorber is each installed at the upper side connecting portion and the lower side connecting portion, and the actuator is located at a position midway of the upper side connecting portion and the lower side connecting portion in such a manner that the second connecting portion and the third connecting portion are located at the position midway of the upper side connecting portion and the lower side connecting portion such that an amount of the displacement decreases.

* * * * *